US011162721B2

(12) United States Patent
Cho et al.

(10) Patent No.: US 11,162,721 B2
(45) Date of Patent: Nov. 2, 2021

(54) GAS-LIQUID SEPARATION DEVICE FOR VEHICLE

(71) Applicants: HYUNDAI MOTOR COMPANY, Seoul (KR); KIA MOTORS CORPORATION, Seoul (KR); DOOWON CLIMATE CONTROL CO., LTD., Asan-si (KR); HANON SYSTEMS, Daejeon (KR)

(72) Inventors: Wan Je Cho, Hwaseong-si (KR); Namho Park, Hwaseong-si (KR); Jae Yeon Kim, Asan-si (KR); Yeon Ho Kim, Seoul (KR); Seoyoung Oh, Uijeongbu-si (KR); Chul Min Kim, Asan-si (KR); Young Chul Kim, Jeonju-si (KR); Jae Min Lee, Sejong-si (KR)

(73) Assignees: HYUNDAI MOTOR COMPANY, Seoul (KR); KIA MOTORS CORPORATION, Seoul (KR); DOOWON CLIMATE CONTROL CO., LTD., Asan-si (KR); HANON SYSTEMS, Daejeon (KR)

( * ) Notice: Subject to any disclaimer, the term of this patent is extended or adjusted under 35 U.S.C. 154(b) by 171 days.

(21) Appl. No.: 16/549,272

(22) Filed: Aug. 23, 2019

(65) Prior Publication Data

US 2020/0378663 A1 Dec. 3, 2020

(30) Foreign Application Priority Data

May 31, 2019 (KR) ..... 10-2019-0064819

(51) Int. Cl.
*F25B 43/00* (2006.01)
*F25B 43/02* (2006.01)

(52) U.S. Cl.
CPC ..... *F25B 43/006* (2013.01); *F25B 43/003* (2013.01); *F25B 43/02* (2013.01); *F25B 2400/23* (2013.01)

(58) Field of Classification Search
CPC ..... F25B 43/00; F25B 43/003; F25B 43/006; F25B 43/02; F25B 2339/044;
(Continued)

(56) References Cited

U.S. PATENT DOCUMENTS 4,182,136 A * 1/1980 Morse ..... F25B 43/006 62/503
4,187,695 A * 2/1980 Schumacher ..... F25B 41/00 62/116
(Continued)

FOREIGN PATENT DOCUMENTS

EP 1249674 A2 * 10/2002 ..... B01D 53/261
EP 1795835 A2 * 6/2007 ..... F25B 9/008
(Continued)

OTHER PUBLICATIONS

JP-2000356439-A_English_machione_translation.pdf (Year: 2000).*

*Primary Examiner* — Jianying C Atkisson
*Assistant Examiner* — Jose O Class-Quinones
(74) *Attorney, Agent, or Firm* — Morgan, Lewis & Bockius LLP

(57) ABSTRACT

A gas-liquid separation device for a vehicle includes: a housing of which an upper surface is opened and a lower surface is closed; a cover disposed on the upper surface of the housing, and the cover having an outlet disposed at a center region of the cover and an inlet disposed at a portion spaced apart from the center region; an exhaust pipe of which an upper end is connected to the outlet; a guide pipe having a cylinder shape with an upper surface opened and having a gas refrigerant flow space; a mounting cap disposed on the lower surface of the housing; and a refrigerant guider
(Continued)

disposed on the cover inside the housing to prevent a liquid refrigerant from flowing into the gas refrigerant flow space among a refrigerant flowing into the inlet.

11 Claims, 6 Drawing Sheets

(58) Field of Classification Search
CPC ..... F25B 2339/0441; F25B 2339/0442; F25B 2339/0444; F25B 2339/0446; F25B 2400/02; F25B 2400/03; F25B 2400/0413; F25B 2400/0415; F25B 2400/23; F25B 2500/28
See application file for complete search history.

(56) References Cited

U.S. PATENT DOCUMENTS 4,199,960 A * 4/1980 Adams ..... F25B 43/006 55/463
4,627,247 A * 12/1986 Morse ..... F25B 43/006 62/503
4,651,540 A * 3/1987 Morse ..... F25B 43/006 55/441
4,768,355 A * 9/1988 Breuhan ..... F25B 43/006 261/DIG. 6
4,827,725 A * 5/1989 Morse ..... F25B 43/006 62/503
4,938,037 A * 7/1990 Carlisle, Jr. ..... F25B 43/006 137/590
5,050,401 A * 9/1991 Van Steenburgh, Jr. ..... F25B 45/00 62/292
5,076,071 A * 12/1991 Morse ..... F25B 43/006 62/503
5,101,641 A * 4/1992 Van Steenburgh, Jr. ..... F25B 45/00 62/292
5,179,780 A * 1/1993 Wintersteen ..... F25B 43/003 29/422
6,000,233 A * 12/1999 Nishida ..... C10M 171/008 62/114
6,279,341 B1 * 8/2001 Incorvia ..... F25B 43/003 62/474
6,701,745 B1 * 3/2004 Kozinski ..... B60H 1/323 62/244
9,541,316 B2 * 1/2017 Takeda ..... F25B 43/006
9,636,622 B2 * 5/2017 Yamasaki ..... B01D 53/0407
10,190,809 B2 * 1/2019 Hosokawa ..... F25B 43/006
10,215,461 B2 * 2/2019 Hosokawa ..... F25B 43/003
2003/0159455 A1 * 8/2003 Aikawa ..... F25B 5/04 62/225
2008/0041093 A1 * 2/2008 Sung ..... F25B 43/006 62/503
2012/0247146 A1 * 10/2012 Yamada ..... F25B 1/10 62/498
2012/0291461 A1 * 11/2012 Verma ..... F25B 43/006 62/115
2013/0312376 A1 * 11/2013 Huff ..... F25B 43/00 55/457
2013/0319036 A1 * 12/2013 Taras ..... F28F 21/083 62/434
2013/0333402 A1 * 12/2013 Styles ..... B60H 1/3204 62/89
2014/0331713 A1 * 11/2014 Takeda ..... F25B 43/006 62/503
2015/0231549 A1 * 8/2015 Yamasaki ..... F25B 43/006 96/108
2017/0016657 A1 * 1/2017 Hosokawa ..... F25B 13/00
2017/0016658 A1 * 1/2017 Hosokawa ..... F25B 43/003
2017/0167762 A1 * 6/2017 Kato ..... F25B 43/006
2017/0205120 A1 * 7/2017 Ali ..... F25B 40/00

FOREIGN PATENT DOCUMENTS

JP 2000356439 A * 12/2000
WO WO-2007070039 A1 * 6/2007 ..... F25B 43/02

* cited by examiner

GAS-LIQUID SEPARATION DEVICE FOR VEHICLE

CROSS-REFERENCE TO RELATED APPLICATION

This application claims priority to and the benefit of Korean Patent Application No. 10-2019-0064819 filed in the Korean Intellectual Property Office on May 31, 2019, the entire contents of which are incorporated herein by reference.

TECHNICAL FIELD

The present disclosure relates to a gas-liquid separation device for a vehicle. More particularly, the present disclosure relates to a gas-liquid separation device for a vehicle for separating and respectively supplying a gas and liquid refrigerant.

BACKGROUND

Generally, an air conditioning system for a vehicle includes an air conditioner circulating a refrigerant in order to heat or cool an interior of the vehicle.

The air conditioner, which is to maintain the interior of the vehicle at an appropriate temperature regardless of a change in an external temperature to maintain a comfortable interior environment, is configured to heat or cool the interior of the vehicle by heat exchange by an evaporator in a process in which a refrigerant discharged by driving of a compressor is circulated to the compressor through a condenser, a receiver drier, an expansion valve, and the evaporator.

That is, the air conditioner lowers a temperature and a humidity of the interior by condensing a high-temperature high-pressure gas-phase refrigerant compressed from the compressor by the condenser, passing the refrigerant through the receiver drier and the expansion valve, and then evaporating the refrigerant in the evaporator in a cooling mode in summer.

However, in the conventional air conditioner, the receiver drier for supplying a liquid refrigerant removed with moisture and foreign substances among the refrigerant condensed in the condenser to an expansion valve and an accumulator for supplying a gas refrigerant among the refrigerant passing through the evaporator to the compressor are respectively provided, and therefore there is a problem that a manufacturing cost increases due to the increasing of the constituent elements.

In addition, it is difficult to ensure a space to mount the receiver drier and the accumulator inside the small engine compartment and there is a problem that a layout of connection pipes is complicated.

The above information disclosed in this Background section is only for enhancement of understanding of the background of the disclosure and therefore it may contain information that does not form the prior art that is already known in this country to a person of ordinary skill in the art.

SUMMARY

The present disclosure to solve these problems provides a gas-liquid separation device for a vehicle separating a refrigerant supplied from a heat exchanger condensing or evaporating the refrigerant according to a mode of the vehicle into a gas refrigerant and a liquid refrigerant and storing them, and selectively supplying the separated gas refrigerant and liquid refrigerants to a compressor and a condenser.

A gas-liquid separation device for a vehicle according to an exemplary embodiment of the present disclosure includes: a housing of which an upper surface is opened and a lower surface is closed; a cover disposed on the upper surface of the housing so as to seal an inside of the housing, the cover having an outlet disposed at a center region of the cover and an inlet disposed at a portion spaced apart from the center region; an exhaust pipe of which an upper end is connected to the outlet; a guide pipe having a cylinder shape with an upper surface opened so that the exhaust pipe is inserted into the guide pipe and having a gas refrigerant flow space between an exterior circumference of the exhaust pipe and an interior circumference of the guide pipe; a mounting cap disposed on the lower surface of the housing so as to fix a closed lower end of the guide pipe; and a refrigerant guider disposed on the cover inside the housing to prevent a liquid refrigerant from flowing into the gas refrigerant flow space among a refrigerant flowing into the inlet, and refrigerant guider having a cup shape and fixed to the exhaust pipe. In the housing, a refrigerant storage may be formed in a predetermined section from a lower end toward an upper part based on a length direction.

The refrigerant storage may have a diameter formed of a length smaller than an upper end diameter of the housing so as to reduce a storing amount of a liquid refrigerant among a refrigerant inflowing to the housing.

A refrigerant pipe for supplying the stored liquid refrigerant to a condenser may be connected to a lower end part of the refrigerant storage.

At least one fixing rib may be formed to be protruded toward the center of the guide pipe on a lower interior circumference in the guide pipe so that the exhaust pipe is fixed to the inner lower part of the guide pipe.

An oil collecting part protruded toward a lower surface of the housing from a lower end center and including an oil groove inside may be integrally formed in the guide pipe.

An oil included in the inside of a gas refrigerant flowed in the gas refrigerant flow space may be collected by own weight in the oil groove.

The mounting cap may have an upper surface that is opened and a lower surface that is closed so that the lower end of the guide pipe is inserted with a predetermined part and at least one opening hole may be formed along a circumference direction so that a liquid refrigerant stored in the housing flows.

In the exhaust pipe, a hang end may be formed on an upper exterior circumference so that the refrigerant guider is disposed at the upper part inside the housing.

Inside the housing, a drying member may be mounted to remove foreign substance and moisture included in the inflowed refrigerant.

The drying member may be mounted through a mounting ring formed inside the refrigerant guider in the housing.

The inlet may be connected to a heat exchanger condensing and evaporating the refrigerant and the outlet is connected to a compressor.

According to the gas-liquid separation device for the vehicle of an exemplary embodiment of the present disclosure, the refrigerant supplied from the heat exchanger condensing and evaporating the refrigerant according to a mode of the vehicle is divided into the gas refrigerant and the liquid refrigerant, and the divided gas refrigerant and liquid refrigerant are selectively suppled to the compressor and the condenser, thereby reducing the manufacturing cost by reducing the entire constituent element of the air condition device.

In addition, the present disclosure may reduce the entire constituent elements of the air condition device by performing the functions of the conventional receiver drier and the accumulator, and simplify the layout simultaneously while securing the mounting space within the narrow engine compartment have.

DETAILED DESCRIPTION OF THE EMBODIMENTS

Figure 1:
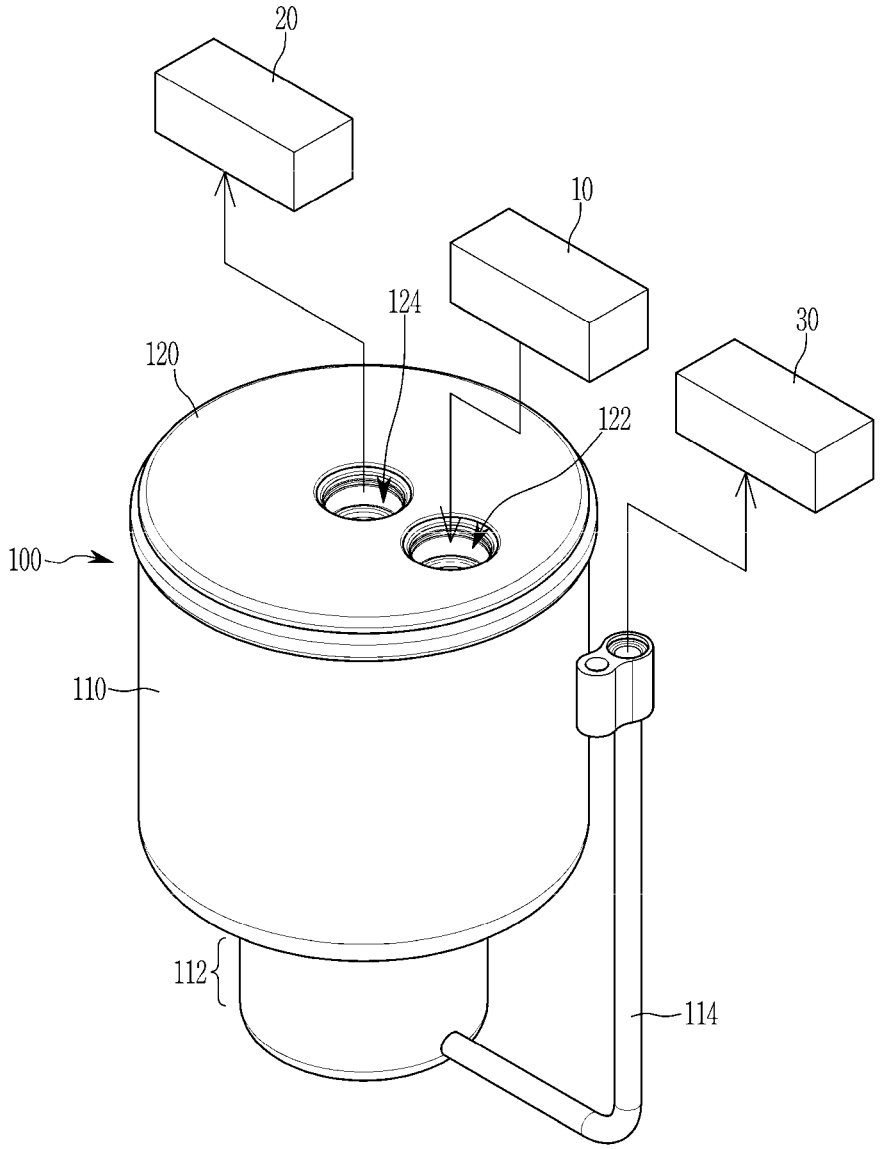
FIG. 1 is a perspective view of a gas-liquid separation device for a vehicle according to an exemplary embodiment of the present disclosure.

An exemplary embodiment of the present disclosure will hereinafter be described in detail with reference to the accompanying drawings.

Exemplary embodiments described in the present specification and a configuration shown in the drawings are just the most preferable exemplary embodiment of the present disclosure, but are not limited to the spirit and scope of the present disclosure. Therefore, it should be understood that there may be various equivalents and modifications capable of replacing them at the time of filing of the present application.

In order to clarify the present disclosure, parts that are not connected with the description will be omitted, and the same elements or equivalents are referred to as the same reference numerals throughout the specification.

The size and thickness of each element are arbitrarily shown in the drawings, and the present disclosure is not necessarily limited thereto, and in the drawings, the thickness of layers, films, panels, regions, etc., are exaggerated for clarity.

Throughout this specification and the claims which follow, unless explicitly described to the contrary, the word "comprise" or variations such as "comprises" or "comprising" will be understood to imply the inclusion of stated elements but not the exclusion of any other elements.

Further, the terms, " . . . unit", " . . . mechanism", " . . . portion", " . . . member" etc. used herein mean the unit of inclusive components performing at least one or more functions or operations.

Figure 2:
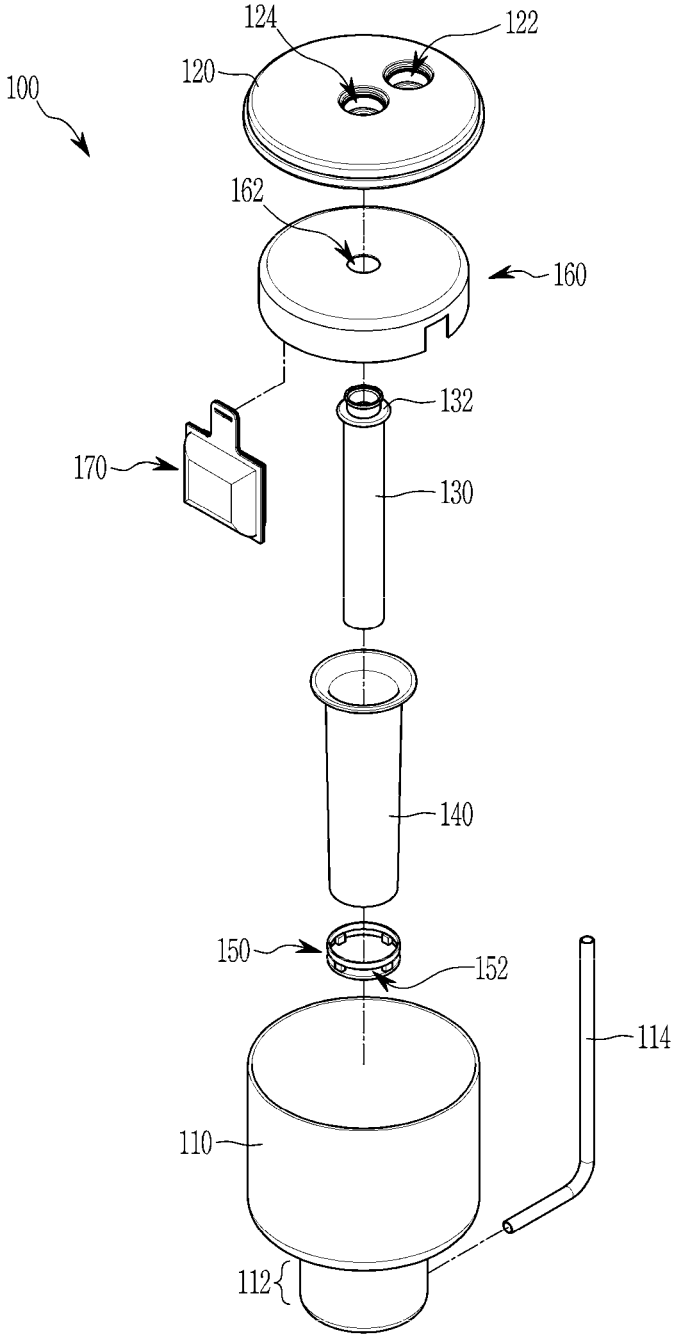
FIG. 2 is an exploded perspective view of a gas-liquid separation device for a vehicle according to an exemplary embodiment of the present disclosure.
Figure 3:
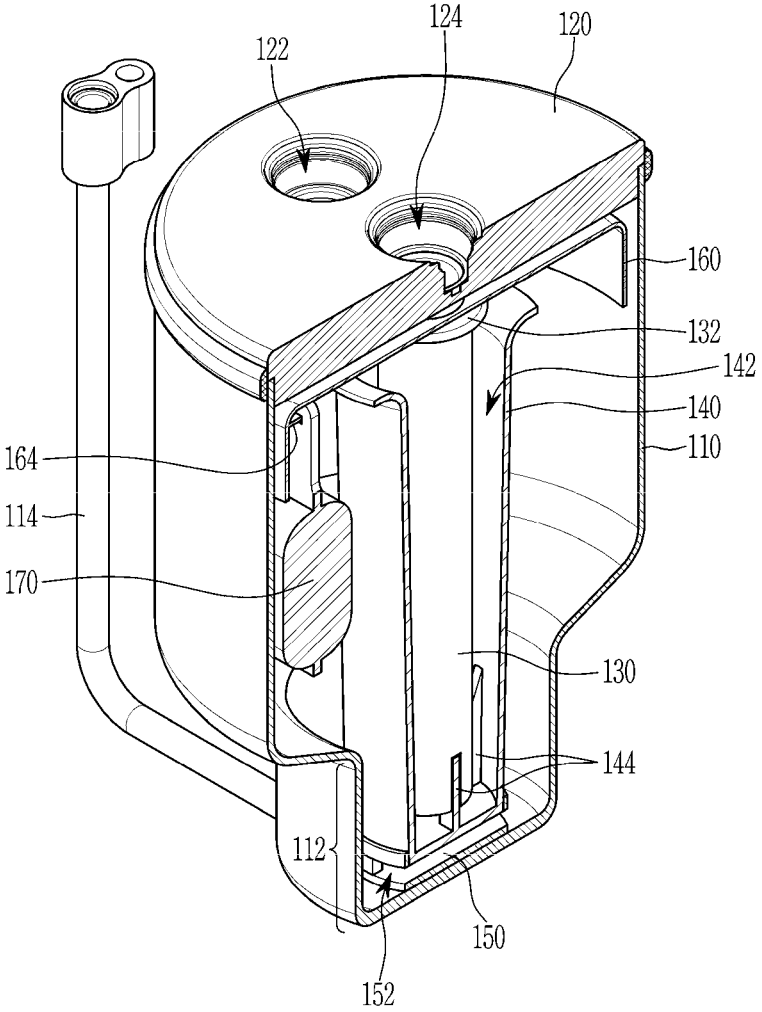
FIG. 3 is a partially cut-away perspective view of a gas-liquid separation device for a vehicle according to an exemplary embodiment of the present disclosure.
Figure 4:
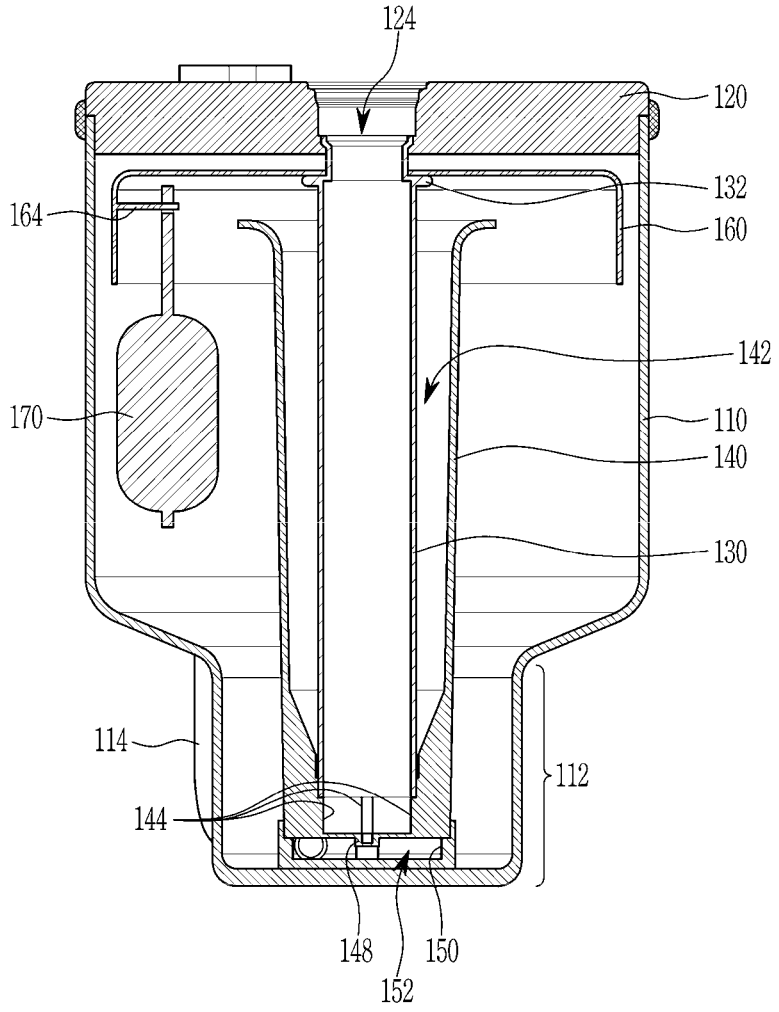
FIG. 4 is a cross-sectional view of a gas-liquid separation device for a vehicle according to an exemplary embodiment of the present disclosure.
Figure 5:
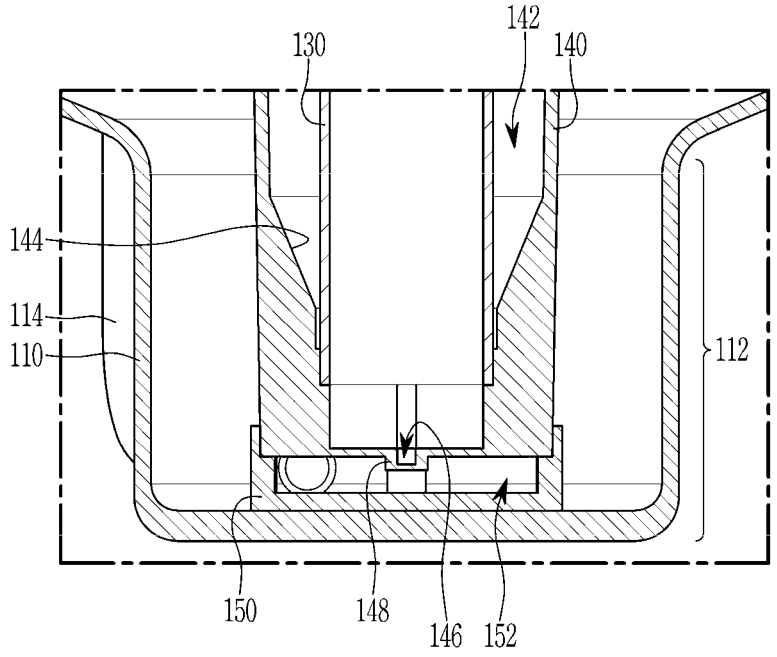
FIG. 5 is a partial enlarged cross-sectional view to explain an oil collecting part in a gas-liquid separation device for a vehicle according to an exemplary embodiment of the present disclosure.

FIG. 1 is a perspective view of a gas-liquid separation device for a vehicle according to an exemplary embodiment of the present disclosure, FIG. 2 is an exploded perspective view of a gas-liquid separation device for a vehicle according to an exemplary embodiment of the present disclosure, FIG. 3 is a partially cut-away perspective view of a gas-liquid separation device for a vehicle according to an exemplary embodiment of the present disclosure, FIG. 4 is a cross-sectional view of a gas-liquid separation device for a vehicle according to an exemplary embodiment of the present disclosure, and FIG. 5 is a partial enlarged cross-sectional view to explain an oil collecting part in a gas-liquid separation device for a vehicle according to an exemplary embodiment of the present disclosure.

Referring to drawings, a gas-liquid separation device for a vehicle 100 according to an exemplary embodiment of the present disclosure may divide a refrigerant supplied from a heat exchanger 10 condensing and evaporating the refrigerant according to a mode of the vehicle into a gas refrigerant and a liquid refrigerant and store them, and selectively supply the divided gas refrigerant and liquid refrigerant to a compressor 20 and a condenser 30, respectively.

Here, the heat exchanger 10 may be a water-cooled heat exchanger that heat-exchanges the refrigerant with a coolant.

For this, the gas-liquid separation device for the vehicle 100 an exemplary embodiment of the present disclosure, as shown in FIG. 1 to FIG. 4, may include a housing 110, a cover 120, an exhaust pipe 130, a guide pipe 140, a mounting cap 150, and a refrigerant guider 160.

First, the housing 110 is formed of a cylinder shape, and the upper surface is opened and the lower surface is closed based on the length direction.

The cover 120 is formed of a disc shape and is mounted on the opened upper surface of the housing 110 so as to close and seal the inside of the housing 110 and an inlet 122 and an outlet 124 are respectively formed at one side and the center.

Here, in the housing 110, a refrigerant storage 112 may be formed in a predetermined section from the lower end toward the upper part based on the length direction.

In the refrigerant storage 112, a diameter is formed of the length that is smaller than the upper end diameter of the housing so that the storing amount of the liquid refrigerant among the refrigerant inflowing inside the housing 110 decreases.

A refrigerant pipe 114 for supplying the stored liquid refrigerant inside to the condenser 30 may be connected to the lower end part of the refrigerant storage 112.

Here, the condenser 30 may be an air-cooled condenser disposed in front of the vehicle.

That is, among the refrigerant flowed in from the heat exchanger 10 to the inside of the housing 110 through the inlet 122, the liquid refrigerant may be stored in the refrigerant storage 112 and selectively supplied to the condenser 30 through the refrigerant pipe 114 if necessary.

In the present disclosure, the upper end of the exhaust pipe 130 is connected to the outlet 124 inside the housing 110.

The upper surface of the guide pipe 140 is formed of the opened cylinder shape so that the exhaust pipe 130 is inserted inside. The interior circumference of the guide pipe 140 may form a gas refrigerant flow space 142 with the exterior circumference of the exhaust pipe 130.

The gas refrigerant flows into the gas refrigerant flow space 142 and the gas refrigerant passed through the gas refrigerant flow space 142 may be exhausted to the outlet 124 through the exhaust pipe 130.

Here, the exhaust pipe 130 may be disposed toward the upper part at a position spaced apart from the closed lower end of the guide pipe 140 by a predetermined distance. Accordingly, the gas refrigerant flowed into the gas refrigerant flow space 142 may be smoothly inflow from the lower part of the guide pipe 140 to the opened lower end of the exhaust pipe 130.

Here, in the guide pipe 140, at least one fixing rib 144 may be formed to be protruded toward the center of the guide pipe 140 on the lower interior circumference so that the exhaust pipe 130 is fixed to the inside lower part of the guide pipe 140.

In the present disclosure, the fixing ribs 144 may be respectively formed at the positions separated by 90 degrees around the inner circumferential surface of the guide pipe 140.

Accordingly, if the exhaust pipe 130 is inserted into the guide pipe 140, the lower exterior circumference of the exhaust pipe 130 may be stably fixed inside the guide pipe 140 by being supported by the fixing ribs 144.

On the other hand, in the present disclosure, four fixing ribs 144 are formed to be spaced by the angle of 90 degrees along the circumferential direction on the interior circumference of the guide pipe 140 as an exemplary embodiment, however, the present disclosure is not limited thereto, and the position and number of the fixing ribs 144 may be changed and applied.

In the present disclosure, the mounting cap 150 may be mounted inside the closed lower end of the housing 110 so as to fix the closed lower end of the guide pipe 140 inside the housing 110.

Here, in the mounting cap 150, the upper surface may be opened and the lower surface may be closed so that the lower end of the guide pipe is inserted with a predetermined part.

In addition, at least one opening hole 152 may be formed in the mounting cap 150 along the circumferential direction so that the liquid refrigerant stored in the lower portion of the inside of the housing 110 flows.

Here, the opening holes 152 may be formed at four positions spaced apart from each other along the circumferential direction of the mounting cap 152 by the predetermined angle.

This opening hole 152 may smoothly flow the liquid refrigerant stored in the refrigerant storage 112. Accordingly, the liquid refrigerant stored in the refrigerant storage 112 may be exhausted smoothly through the refrigerant pipe 114 without disturbing the flow by the mounting cap 150.

In the present disclosure, the refrigerant guider 160 is disposed closer to the cover 120 side inside the housing 110 so as to prevent the liquid refrigerant from inflowing into the gas refrigerant flow space 142 among the refrigerant flowing into the inlet 122.

The refrigerant guider 160 may be formed in a circular cup shape and fixed to the upper part of the exhaust pipe 130.

In the exhaust pipe 130, a hang end 132 may be formed at an upper outer circumference so that the refrigerant guider 160 is disposed inside the upper part of the housing 110.

That is, the refrigerant guider 160 is formed with the cylinder surface having the opened lower surface and the closed upper surface. The refrigerant guider 160 may be inserted into the upper end portion of the exhaust pipe 130 through the insertion hole 162 formed at the center to be assembled.

The hang end 132 may support the lower part of the upper surface of the refrigerant guider 160 so that the refrigerant guider 160 is fixed to the upper part of the exhaust pipe 130. Thus, the refrigerant guider 160 may be secured to the upper part of the exhaust pipe 130.

A drying member 170 may be mounted inside the housing 110 to remove the foreign substance and moisture contained in the refrigerant flowing through the inlet 122.

The drying member 170 may be mounted within the housing through a mounting ring 164 formed inside the refrigerant guider 160.

Accordingly, the drying member 170 can be easily mounted to the mounting ring 164 after the refrigerant guider 160 is assembled to the refrigerant pipe 130.

In addition, when the replacement of the drying member 170 is required, the drying member 170 may be easily removed from the mounting ring 164, thereby mounting and replacement workability may be improved.

On the other hand, in the present disclosure, as shown in FIG. 5, in the guide pipe 140, an oil collecting part 148, which is protruded from the lower end center toward the lower surface of the housing 110 and has an oil groove 146 therein, may be integrally formed.

In the oil groove 146, the oil contained inside the gas refrigerant flowing in the gas refrigerant flow space 142 may be collected by its own weight.

Hereinafter, the operation and action of the gas-liquid separation device for the vehicle 100 as above-configured according to an exemplary embodiment of the present disclosure is described in detail.

Figure 6:
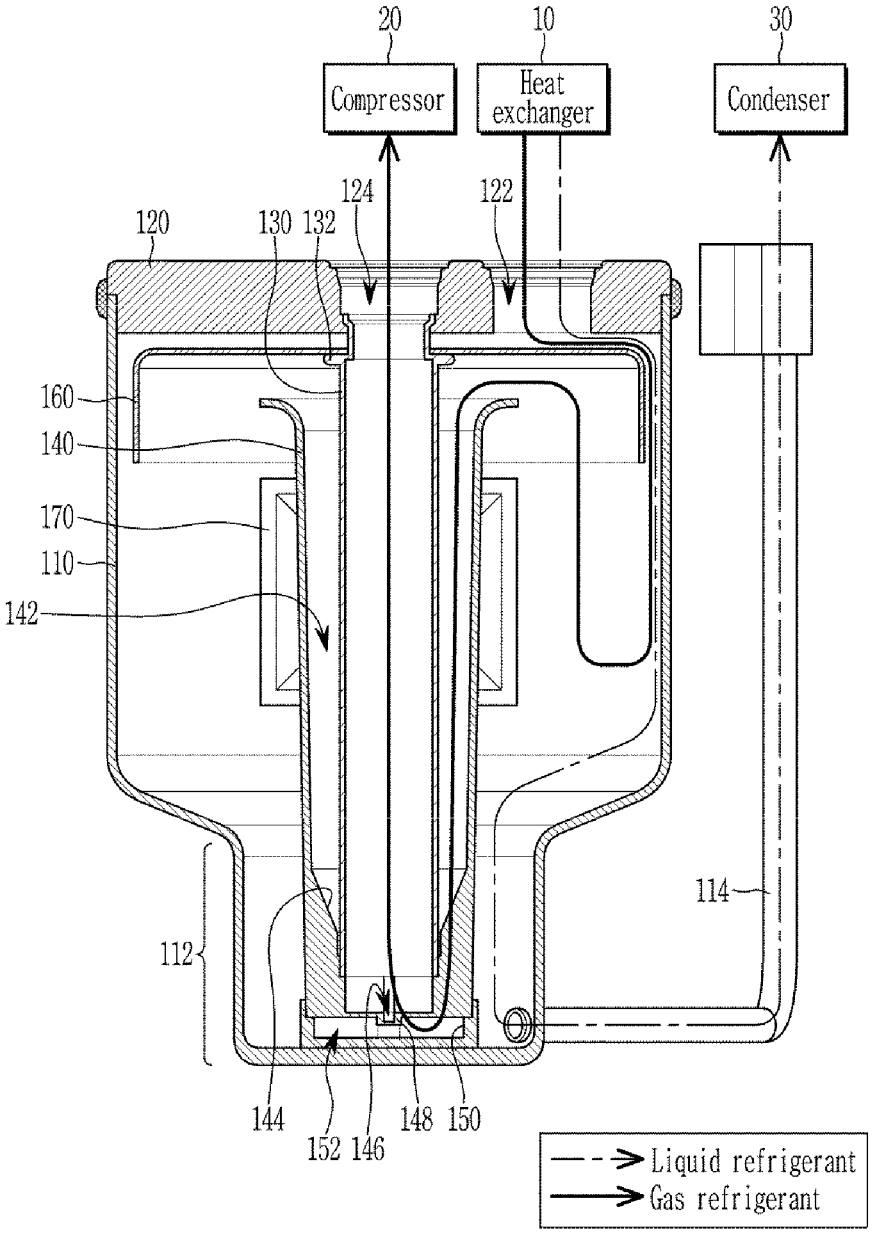
FIG. 6 is a use state diagram of a gas-liquid separation device for a vehicle according to an exemplary embodiment of the present disclosure.

FIG. 6 is a use state diagram of a gas-liquid separation device for a vehicle according to an exemplary embodiment of the present disclosure.

Referring to FIG. 6, the thermal-exchanged refrigerant in the heat exchanger 10 flows into the housing 110 through the inlet 122 with a mixture state of gas and liquid.

The mixed refrigerant which flowed into the inlet 122 is prevented from flowing to the gas refrigerant flow space 142 by the refrigerant guider 160 of which the upper surface is closed and flows under the housing 110 along the inside surface of the housing 110.

Here, the desiccating agent 170 removes the foreign substance and moisture contained in the mixed refrigerant and simultaneously separates the gas refrigerant contained in the liquid refrigerant.

Accordingly, the gas refrigerant of a light weight may be disposed in the upper portion inside the housing 110, and the liquid refrigerant of a relatively heavy weight may be disposed in the lower portion inside the housing 110.

In this state, when the refrigerant is supplied to the compressor 20, the light weight gas refrigerant inflows from the upper part of the guide pipe 140 into the gas refrigerant flow space 142 inside the housing 110.

While the gas refrigerant which flowed into the gas refrigerant flow space 142 flows downward from the upper portion of the gas refrigerant flow space 142 to the lower portion of the exhaust pipe 130 and flows toward the outlet 124 from the inner lower portion of the exhaust pipe 130.

At this time, the oil contained in the gas refrigerant is collected into the oil groove 146 by its own weight in the oil collecting part 148, so that the pure gas refrigerant may be supplied to the compressor 20 through the outlet 124.

On the other hand, the liquid refrigerant having the relatively heavy weight compared with the gas refrigerant flows from the upper part to the lower part by own weight along the inner surface of the housing 110, and is finally stored in the refrigerant storage 112.

When supplying the refrigerant to the condenser 30, the liquid refrigerant stored in the refrigerant storage 112 may be smoothly suppled to the condenser 30 through the refrigerant pipe 114.

That is, the gas-liquid separation device for the vehicle 100 according to an exemplary embodiment of the present disclosure may smoothly divide the refrigerant supplied from the heat exchanger 10 into the gas refrigerant and the liquid refrigerant to be respectively stored so as to supply the gas refrigerant to the compressor 20 and the liquid refrigerant to the condenser 30.

Accordingly, if the gas-liquid separation device for the vehicle 100 as above-configured according to an exemplary embodiment of the present disclosure is applied, the refrigerant supplied from the heat exchanger 10 condensing and evaporating the refrigerant according to the mode of the vehicle is divided into the gas refrigerant and the liquid refrigerant and stored, and the divided gas refrigerant and liquid refrigerant are selectively suppled to the compressor 20 and the condenser 30, thereby reducing the manufacturing cost by reducing the entire constituent element of the air condition device.

In addition, the present disclosure may reduce the entire constituent elements of the air condition device by performing the functions of the conventional receiver drier and the accumulator, and simplify the layout simultaneously while securing the mounting space within the narrow engine compartment have.

While this disclosure has been described in connection with what is presently considered to be practical exemplary embodiments, it is to be understood that the present disclosure is not limited to the disclosed embodiments. On the contrary, it is intended to cover various modifications and equivalent arrangements included within the spirit and scope of the appended claims.

What is claimed is:

1. A gas-liquid separation device for a vehicle comprising:

a housing of which an upper surface is opened and a lower surface is closed;

a cover disposed on the upper surface of the housing so as to seal an inside of the housing, the cover having an outlet disposed at a center region of the cover and an inlet disposed at a portion spaced apart from the center region;

an exhaust pipe of which an upper end is connected to the outlet;

a guide pipe having a cylinder shape with an upper surface opened so that the exhaust pipe is inserted into the guide pipe, the guide pipe further having a gas refrigerant flow space between an exterior circumference of the exhaust pipe and an interior circumference of the guide pipe;

a mounting cap disposed on the lower surface of the housing so as to fix a closed lower surface of the guide pipe;

a refrigerant guider disposed on the cover inside the housing to prevent a liquid refrigerant from flowing into the gas refrigerant flow space among a refrigerant flowing into the inlet, the refrigerant guider having a cup shape and fixed to the exhaust pipe; and an oil collecting part protruding toward the lower surface of the housing from a lower end center of the guide pipe, the oil collecting part including an oil groove.

2. The gas-liquid separation device of claim 1, wherein the housing includes a refrigerant storage in a section extending from the lower surface toward the upper surface of the housing in a length direction.

3. The gas-liquid separation device of claim 2, wherein the refrigerant storage has a diameter smaller than that of the upper surface of the housing so as to reduce a storing amount of the liquid refrigerant.

4. The gas-liquid separation device of claim 2, further comprising a refrigerant pipe, supplying the liquid refrigerant to a condenser, connected to a lower end part of the refrigerant storage.

5. The gas-liquid separation device of claim 1, further comprising at least one fixing rib protruding toward a center of the guide pipe on a lower interior circumference in the guide pipe so that the exhaust pipe is fixed to an inner lower part of the guide pipe.

6. The gas-liquid separation device of claim 1, wherein the gas refrigerant flow space is configured such that an oil included in a gas refrigerant flowing into the gas refrigerant flow space is collected in the oil groove by a weight of the oil.

7. The gas-liquid separation device of claim 1, wherein the mounting cap has an upper surface that is opened and a lower surface that is closed so that the lower surface of the guide pipe is seated inside the mounting cap, and wherein the mounting cap has at least one opening hole arranged along a circumference direction so that the liquid refrigerant flows therein.

8. The gas-liquid separation device of claim 1, wherein the exhaust pipe has a hang end on an upper exterior circumference so that the refrigerant guider is disposed at the upper part inside the housing.

9. The gas-liquid separation device of claim 1, wherein the housing has a drying member therein configured to remove a foreign substance and moisture included in the refrigerant.

10. The gas-liquid separation device of claim 9, wherein the refrigerant guider includes a mounting ring which couples the drying member to the refrigerant guider.

11. The gas-liquid separation device of claim 1, wherein the inlet is connected to a heat exchanger configured to condense or evaporate the refrigerant, and the outlet is connected to a compressor.

* * * * *